United States Patent [19]

Kupsa

[11] Patent Number: 4,768,588

[45] Date of Patent: Sep. 6, 1988

[54] CONNECTOR ASSEMBLY FOR A MILLING TOOL

[76] Inventor: Charles M. Kupsa, 710 Swiss Ct., College Station, Tex. 77840

[21] Appl. No.: 942,328

[22] Filed: Dec. 16, 1986

[51] Int. Cl.[4] ..... E21B 29/00

[52] U.S. Cl. ..... 166/55; 166/240; 166/376; 175/320; 403/349

[58] Field of Search ..... 166/98, 99, 376, 377, 166/378, 381, 237, 240, 242, 55; 175/320; 403/348, 349

[56] References Cited

U.S. PATENT DOCUMENTS

| | | | |
|---|---|---|---|
| 1,873,241 | 8/1932 | Wright | 403/349 |
| 2,213,498 | 10/1940 | Kinzbach | 29/103 |
| 2,322,695 | 6/1943 | Kinzbach | 164/0.8 |
| 2,999,541 | 10/1961 | Kinzbach et al. | 166/55.7 |
| 3,220,478 | 11/1965 | Kinzbach | 166/55.8 |
| 3,341,237 | 9/1967 | Anzalone | 175/320 |
| 3,494,418 | 2/1970 | Young | 166/237 |
| 3,785,690 | 1/1974 | Hutchinson | 166/99 |

FOREIGN PATENT DOCUMENTS 0004598 of 1909 United Kingdom ..... 403/349

OTHER PUBLICATIONS

Bowen Catalog, 1986, pp. 513, 514, 519, 520, 521, 522, 523, 525, 526, 527, 528, 529, 531, 537, 540, 541, 543.
Baker Catalog, 1974, pp. 501, 502.

*Primary Examiner*—Jerome Massie
*Assistant Examiner*—Terry Lee Melius
*Attorney, Agent, or Firm*—Vaden, Eickenroht, Thompson & Boulware

[57] ABSTRACT

For use in a wellbore, a connector assembly for connection to and use with a variety of downhole tools and apparatuses and methods for effecting such use; and tools including such a connector assembly in combination and methods for the use of such tools. The connector assembly has a T-shaft with shoulders extending therefrom and a slot cylinder for receiving, holding, and supporting the T-shaft. Slots and recesses are provided in the slot cylinder for receiving, transmitting and encompassing the T-shaft's shoulders.

4 Claims, 2 Drawing Sheets

CONNECTOR ASSEMBLY FOR A MILLING TOOL

BACKGROUND OF THE INVENTION

1. Field of the invention

This invention is directed to a connector assembly (or "sub") for use with various downhole tools and apparatuses. It is particularly useful with milling tools, taper taps, jars, die collars, overshots, spears, washpipe, fishing apparatuses, and junk baskets. This invention is also directed to the various combination tools and apparatuses which include the connector assembly.

2. Description of the prior art

Prior art connection assemblies are complex and often require a trip out of a wellbore for various phases of operation. Prior art tools and apparatuses, e.g. milling tools are complicated and also offer require multiple trips into and out of the hole to achieve their desired functions.

The prior art Baker Model C-1 milling tool has a connector assembly with a milling shoe or "burning shoe" and a stinger with an expandable grapple and a milling end. This miling tool is used, e.g., to remove a packer from a wellbore. In order to remove a packer using the Baker Model C-1 milling tool, the stinger with its grapple must be inserted through ("sting through") and beyond the packer. This usually requires some milling of the exterior of the packer by the burning shoe and of the interior of the packer by the milling end of the stinger, particularly if there is any obstruction inside the packer. After stinging through the packer, the grapple is expanded to hold the packer so that the milling tool and packer can be pulled out of the wellbore.

Many packers have extendable slips which extend from the packer to secure it in the wellbore. These slips must either retract back into the packer before its removal or they must be milled off prior to pulling the packer out of the hole.

Various problems are encountered when using the Baker Model C-1 milling tool. In various situations it is necessary to remove the tool from a packer, for example: When a stinger is accidentally stung into a packer (as when the depth of the packer has been misjudged); when an attempt is made to pull the packer and it hangs up in the wellbore; when the packer has not been properly milled; or when the slips either fail to retract or have not been properly milled). The grapple has to be contracted or unseated to relinquish its hold on the packer so that the tool can be removed from the packer. In order to re-set the grapple, the entire tool must then be removed from the wellbore, the packer must be re-set, and then be run back into the well-bore to the packer. This in an expensive procedure in an environment in which rig time can cost over $100,000 per day. A trip out and into a wellbore of 10,000 feet can take eight hours.

With prior art devices, the use of an overshot for removing pipe or other items from a hole can require multiple trips into and out of the hole. For example, a string with an overshot may be lowered into a hole to retrieve a piece of pipe. In pulling out of the hole once the pipe has been grappled by the overshot, the pipe may hang up or catch on some element in the wellbore. The overshot would have to be released and a milling tool inserted to mill away the obstruction. The milling tool would then have to be removed from the hole and the overshot would be re-inserted and another attempt made to grapple the pipe and pull it out.

There has been a long-felt need for a connection assembly which is simple, efficient, and easily repairable; and for a connection assembly for use with tools and apparatuses, e.g. a milling tool, which does not require multiple trips into and out of a wellbore to achieve its purposes.

SUMMARY OF THE PRESENT INVENTION

The present invention is directed to a connector assembly useful with various down hole tools and mechanisms and particularly useful with and as a milling apparatus. The connector assembly has a T-shaft and a slot cylinder for receiving and holding the T-shaft. The T-shaft is rotatable within the slot cylinder or it can be held against rotation. The T-shaft is an elongated cylindrical member having two opposed radially extending shoulders. For convenience the ends of the T-shaft may be threaded or otherwise fashioned for connection to other tools or mechanisms. There may be a channel throughout the length of the T-shaft from one end to the other. This channel may be used for running other tools or lines through the shaft, e.g. for wireline work required within pipe or casing. The T-shaft may be solid or it may have partial recesses at one or both ends, depending on the tools, mechanisms, or subs to be connected to the T-shaft. As required, T-shaft extensions may be connected to the T-shaft.

The slot cylinder is a generally hollow cylinder with an inner intermediate holding ring for receiving and holding the T-shaft. The ring has a slot into which the T-shaft's shoulders can fit and pass through. The slot communicates with a recess in the ring into which the T-shaft's shoulders can be moved once they have passed through the ring slot. When the shoulders have been received in the ring recess, turning the T-shaft slightly secures the shoulders within the ring recess so that they are prevented from moving back out of the slot cylinder until the T-shaft is again turned in the opposite direction. The recess also supports the T-shaft and whatever is connected to the T-shaft. The surface of the ring which first comes in contact with the T-shaft's shoulders can be bevelled so that the shoulders move easily into the ring recess. Such bevelling will also make it unnecessary to have the shoulders aligned precisely with the ring slot in order to insert the shoulders through the slot and into the recess.

The slot cylinder may be threaded or otherwise fashioned at one or both ends for facilitating its connection to other tools, mechanisms or subs. For example, one end of the slot cylinder can be threaded for connection to a milling shoe so that the combination of the connector assembly and milling shoe can be used effectively as a milling tool. Such a combination can also be used with a conventional fishing spear connected to the T-shaft. Hollow cylindrical extensions may be added to the slot cylinder. For example, if a relatively long packer is to be removed a corresponding cylinder extension can be used between the slot cylinder and a burning shoe.

The connector assembly according to the present invention can also be used effectively with an overshot to pull a retrievable packer. An overshot is a tool which grips (or "grapples") the outside of a member such as a piece of pipe or packer in a wellbore. Such an overshot cannot be used with the Baker Milling Tool, because an overshot is positioned at the bottom of a tool and such positioning at the bottom of Baker's Milling Tool would prevent the Baker Tool stinger from functioning. A connector assembly according to the present invention can be used with an extension on the T-shaft which has connected to it an overshot. If the overshot grapples a packer or a piece of pipe to be retrieved and then gets hung up, the overshot is released and pulled back up into the extention of the slot cylinder. Without removing the tool from the hole, the burning shoe can mill the obstructing element. Then when milling is completed, the overshot can again be lowered to grapple the packer or pipe and another attempt can be made to remove it.

The positive holding or stopping of the T-shaft shoulders within the ring recess insures that the T-shaft will not be disengaged from the ring recess unless the T-shaft is turned. If a spear is used at the end of the T-shaft it may have a grapple, but such a grapple need not ever be re-set above the hole, since it can be maintained in position within, but not beyond, (i.e. below) the packer. The spear grapple could be released within the packer simply by taking tension off of the string to which the tool is connected, and turning the T-shaft thereby causing the spear grapple to move into a release position disengaging from the packer's interior walls.

Use of the connector assembly with a milling shoe connected to the slot cylinder and a spear/grapple connected to the T-shaft, permits milling and then stinging with the spear and, if necessary, re-setting of the spear grapple within the hole without having to completely pull the tool to the surface.

In operations to retrieve an element ("fish") from a wellbore which require some milling, an apparatus according to the present invention is very useful. Initially the element to be fished out may need milling to free it from its position in the wellbore. An apparatus according to the present invention is lowered to the location of the fish and milling is commenced. By slightly turning the T-shaft, it is disengaged from the slot cylinder and the T-shaft with a spear connected to it can then be lowered to engage, to jar, or to pull on the fish. If the fish is not loosened, the T-shaft with its spear are pulled back into the slot cylinder (or into a cylinder extension), engaged in the ring recess, and the milling shoe is again lowered to further mill the fish. This procedure may be repeated until the fish is free and can be removed from the hole.

It is therefore an object of the present invention to provide a novel and efficient connector assembly for a variety of downhole tools and apparatuses.

It is also an object of the present invention to provide a variety of combination tools which include such a connector assembly.

Another object of the present invention is the provision of a connector assembly having an outer member and an inner shaft; the shaft being selectively movable from a disengaged position to an engaged position within the outer member; and the shaft being held within a recess in the outer member in the engaged position.

Yet another object of the present invention is the provision of such a connector assembly in which when the shaft is held in the outer member's recess so that it cannot rotate, the recess also serves to support the shaft and whatever is connected to it.

A further object of the present invention is the provision of a combination tool which includes such a connector assembly and one of a variety of other tools, subs, or mechanisms, including but no limited to: milling tools, milling shoes, back off safety subs, taper taps, jars, die collars, overshots, spears, washpipes, fishing apparatuses and junk baskets.

An additional object of the present invention is the provision of a milling tool having grapple means which can be re-set without removing the tool from a wellbore in which it is being used.

A particular object of the present invention is the provision of a connector assembly or a combination using a connector assembly which eliminates the need for multiple trips into and out of a wellbore to effectively perform the operation.

Another particular object of the present invention is the provision of a tool which can effectively utilize an overshot apparatus in fishing operations and in retrieving retrievable packers without the necessity of multiple trips into and out of the wellbore.

An additional object of the present invention is the provision of processes and methods for using the items mentioned in the foregoing objects.

To one of skill in this art who has the benefit of this invention's teachings other and further objects and advantages will be clear from the following description of presently-preferred embodiments of the invention when taken in conjunction with the accompanying drawings.

DESCRIPTION OF THE PREFERRED EMBODIMENTS

Figure 1:
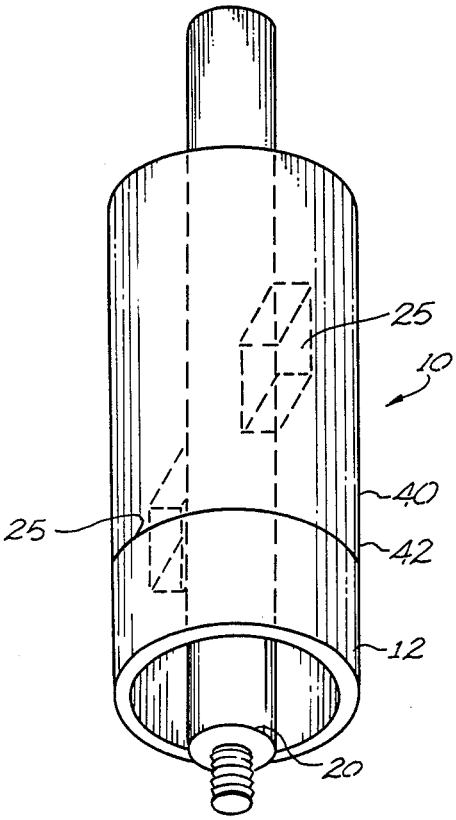
FIG. 1 is a perspective view of a connector assembly and of a milling tool with the connector assembly according to the present invention.

As shown in FIG. 1 a connector assembly 10 has a T-shaft 20 and an outerslot cylinder 40. In the embodiment shown in FIG. 1 a milling shoe or burning shoe 12 is threadedly connected to a "down" end 42 of the slot cylinder 40 so that the combination of the connector assembly 40 and the burning shoe 12 may be used as a milling tool. (FIG. 1 does not depict the means within the connector assembly for receiving and holding the internal shaft).

Figure 3:
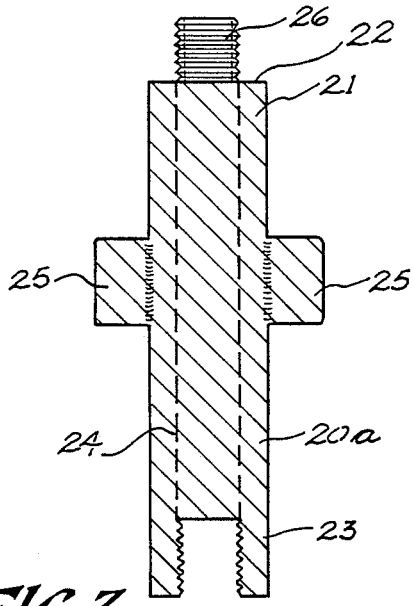
FIG. 3 is a cross-sectional view of a T-shaft useful in an assembly or tool according to the present invention.
Figure 4:
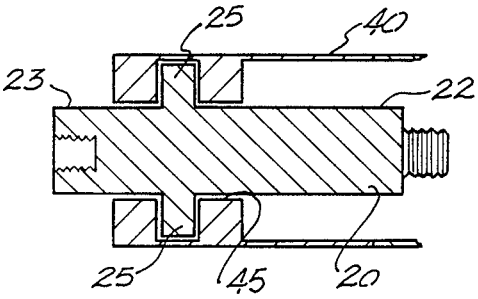
FIG. 4 is a cross-sectional view of a T-shaft and slot cylinder of the assembly of FIG. 1.

The T-shaft 20 is shown in detail in FIG. 4. It has a central shaft body 21, "down" end 22, and an "up" end 23. As shown in FIG. 3 the ends 22 and 23 are threaded for mating connection with other elements; but these ends need not be threaded for mating connection with other elements. They can be fashioned with some other means or structure for connection to other elements. Also, in the embodiment of FIG. 3, there is shown a channel 24 extending through the length of the T-shaft 20*a* and a channel 26 extending through the threaded portion of the end 22, the two channels communicating with each other. This channel 24 is useful for permitting the passage of other apparatuses through the T-shaft, such as a wireline and its associated tools and apparatuses.

The T-shaft 20 has dual opposed radially extending shoulders 25 which may be positioned somewhere between the ends 22 and 23, and are shown in FIG. 3 as being closer to end 22 than to end 23. Of course two or more shoulders may be employed as desired, but the use, e.g. of three shoulders will require a corresponding member of slots in the slot cylinder for receiving the shoulders.

Figure 2:
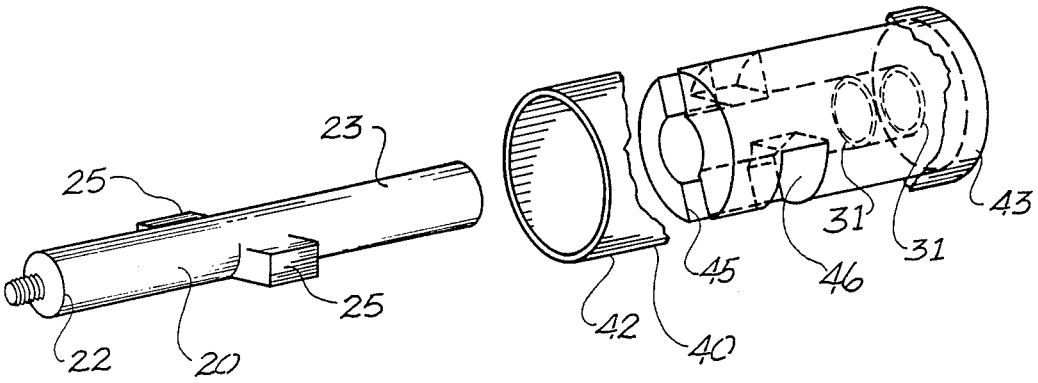
FIG. 2 is a partial cutaway view of the assembly and of the tool of FIG. 1.

The slot cylinder 40 is shown in detail in FIGS. 2 and, 5 and 6. It has a generally cylindrical body member 41 having a "down" end 42 and an "up" end 43. A ring member 44 is connected to or formed integrally of the up end 43 of the slot cylinder 40's body member 41. A slot 45 is provided in the ring member 44 for receiving the shoulders 25 of the T-shaft 20. The disposition of the ring member 44, slot 45, and recess 46 are shown in FIG. 2. The edges of the slot 45 can be bevelled (as at 49 in FIGS. 5, 6, 7) to facilitate the reception in and transmission through the slot 45 of the shoulders 25. Also, the bevelled edges 49 make it unnecessary for the shoulder 25 to be precisely aligned with the slot's opening so that a turning of the T-shaft 20 eases the shoulders 25 into the slot 45.

Figure 6:
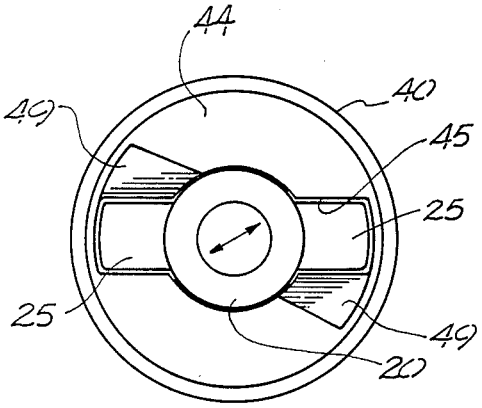
FIG. 6 is an end view of the assembly of FIG. 1 showing the T-shaft in the slot of the slot cylinder.
Figure 7:
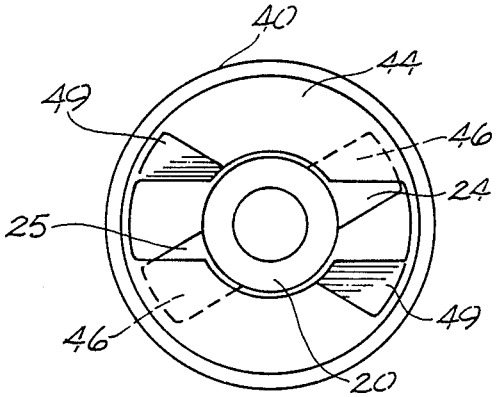
FIG. 7 is an end view of the assembly as in FIG. 6 in which the T-shaft has been slightly rotated to move the T-shaft shoulders into a recess beyond the slot of the slot cylinder.

Once the shoulders 25 have passed through the slot 45 they are received in a ring recess 46 in the ring member 44. This ring recess 46 is configured so that upon turning of the T-shaft 20, the shoulders 25 move into and are held within the ring recess 46. As shown in FIG. 6, the T-shaft 20 is thereby prevented from falling out of or moving out of the ring member 44, unless and until the T-shaft 20 is again rotated in the opposite direction permitting the shoulders 25 to move out through the slot 45. The ends 47 prevent the T-shaft 20 from moving out of the ring recess 46. The ends 48 stop the motion of the T-shaft toward the up end 43 of the slot cylinder 40.

Figure 5:
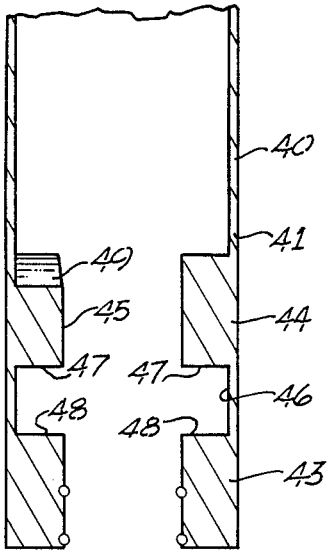
FIG. 5 is a cross-sectional view of the slot cylinder of the assembly and of the tool of FIG. 1.

The down end 42 of the slot cylinder 40 is threaded for mating with elements such as burning shoe 12 as shown in FIG. 5. As required, the slot cylinder or shaft may be extended in length or extensions may be added to the slot cylinder or to the T-shaft. For example, when a spear or overshot is connected to the T-shaft, an extension can be used between the slot cylinder and a milling shoe to prevent the spear or overshot from engaging an item downhold (e.g. packer or stuck pipe) during milling. For example, if a packer six feet in length is to be milled, speared, and retrieved, it is preferred to use an extension of about twenty feet in length between the slot cylinder and the milling shoe (or multiple connected extensions with an overall length of about twenty feet), so that milling can be completed without the spear contacting the packer until the T-shaft is rotated releasing the T-shaft from the ring recess and freeing it for lowering to and into the packer. As shown in FIG. 2 the slot cylinder 40 may have 0-rings disposed in the end 43 for sealing against the T-shaft 20. (Alternatively, 0-rings may be emplaced on the T-shaft itself.)

In a typical packer or fish removal operation employing a tool according to the present invention, a milling shoe (such as shoe 12) is connected to an extension (not shown) which is connected to the cylinder 40. A spear (not shown) is connected to the T-shaft 20 and the T-shaft 20 and spear are raised into the extension and cylinder 40. This combination is run into the wellbore to the location of the packer or fish. With the spear in the raised position (not in contact with the packer or fish), milling on the packer or fish is commenced and accomplished as required. Then, the string to which the tool is connected may be raised slightly to take weight off the milling shoe. The tool is then rotated about a half-turn to permit the T-shaft to disengage from the recess 46 and its shoulders to pass through the slot 45. The T-shaft with its connected spear is then lowered to and into the packer or fish (or if an overshot instead of a spear is being used, the overshot is lowered to and then around the fish). The spear then grips the packer or fish and the tool with the packer or fish is removed from the wellbore. If the packer or fish does not come loose, the T-shaft can be retracted to permit further milling before removal.

To one of skill in this art who has the benefit of this invention's teachings, it will be clear that certain changes can be made in the methods and apparatuses according to this invention without departing from the spirit and scope of the invention as set forth above and in the claims which follow.

What is claimed is:

1. A milling tool comprising a shaft having a first end, a second end, and an elongtated central member and shoulders extending outwardly therefrom a cylindrical body member for co-acting with the shaft, the body member having an open end thereof for receiving the first end of the shaft within the cylinder body member, the body member having a separate ring member connected therein and spaced from the open end of the body member, the ring member having a first recess extending diametrically across the ring member and downwardly therein for receiving both the shaft and the shaft's shoulders, the ring member having second recesses formed therein, the second recesses in communication with the first recess and substantially perpendicular thereto, the second recesses receiving the holding the shaft's shoulders upon passage of the shoulders through the first recess, the shoulders movable into the second recesses by rotating the shaft, the second recesses substantially confining the shoulders once the shoulders are received in the second recesses so that the shaft is substantialy prevented from moving within the ring member toward either end of the cylindrcal body member, and a milling shoe connected to a second end of the cylindrical body member opposite said open end.

2. The tool of claim 1 wherein there are two opposed shoulders.

3. The tool of claim 1 wherein the first recess has bevelled edges on a surface presented to the shaft's shoulders for facilitating the reception of the shoulders into the first recess.

4. The milling tool of claim 1 wherein an extension tubular is connected between the milling shoe and the second end of the cylindrical body member.

* * * * *